United States Patent [19]

Bolza et al.

[11] 4,033,264

[45] July 5, 1977

[54] EXPLOSIVE CARTRIDGE

[75] Inventors: Frederick Bolza, East Hawthorn; Lubos Vojtech Sadek, Essendon; Richard Fox, Rosanna, all of Australia

[73] Assignee: ICI Australia Limited, Victoria, Australia

[22] Filed: Apr. 16, 1975

[21] Appl. No.: 568,684

Related U.S. Application Data

[63] Continuation-in-part of Ser. No. 506,542, Sept. 16, 1974, abandoned.

[52] U.S. Cl. ..... 102/24 R; 149/2; 149/42; 149/43; 149/44; 149/60; 149/61; 149/75; 149/83

[51] Int. Cl.[2] ..... C06C 11/00

[58] Field of Search ..... 149/44, 2, 46, 42, 60, 149/43, 61, 75, 83; 102/24 R

[56] References Cited

UNITED STATES PATENTS

| | | | |
|---|---|---|---|
| 3,869,320 | 3/1975 | Brett et al. | 149/44 X |
| 3,925,123 | 12/1975 | Jessop | 149/44 X |

*Primary Examiner*—Stephen J. Lechert, Jr.
*Attorney, Agent, or Firm*—Cushman, Darby & Cushman

[57] ABSTRACT

Processes whereby water based explosive compositions comprising inorganic oxygen releasing salt material and a synthetic polymeric gelling agent may be converted to a cartridged form and wherein the cartridge container is based on paper are described. The preparation of gelled water bearing systems, especially water based explosive compositions comprising inorganic oxygen releasing salt material, containing gelling agents derived from synthetic polymeric material and a redox system is also described.

22 Claims, 5 Drawing Figures

EXPLOSIVE CARTRIDGE

This is a continuation-in-part of Application Ser. No. 506,542, filed Sept. 16, 1974, now abandoned.

This invention relates to a process for gelling aqueous solutions or dispersions of polymeric materials and to products which may be obtained thereby. More particularly this invention relates to a process for making water bearing gels comprising synthetic copolymeric material of which at least a part is soluble in aqueous media and which is capable of acting as a thickening or gelling agent in such media. Such gels are useful in a variety of industrial applications, thus for example they have been found to be extremely valuable in explosives technology, in the metal, mining, textile, cosmetic, pharmaceutical, horticultural and agricultural industries, and to a lesser extent in other industries, where there is a need for thickened or gelled water based products.

The use of naturally occurring gums as thickening agents for water bearing systems has long been known and more recently synthetic polymeric substances, for example polyacrylamide, have been used for the same purpose. In particular such gums and polymeric materials have been used to form water bearing gels.

Gel formation is particularly desirable when undissolved solids are present in a system and must be maintained in a relatively uniform state of dispersion therein. As used herein, a gel is a mixture, one component of which is water, homogeneous down to substantially colloidal dimensions and capable of resisting a finite shearing force. This resistance to shearing is evidence of some sort of continuous mechanical network or structure which, however, can constitute a relatively small fraction of the total mass of the compositions of which the gel is a component. Thus the gel forms a matrix in which both dissolved and undissolved components can be distributed. Whilst the gums and polymers of the prior art have been reasonably satisfactory as agents for thickening or gelling water bearing systems they have sometimes been found to be deficient in that the degree of thickening or the rate of gelation has been hard to control or that in the instances where gels were formed such gels were physically weak and tended to rupture or in instances where electrolytes were present in the water bearing systems the gel structures were prone to collapse. Such deficiencies sometimes led to segregation of undissolved components in the system and furthermore often resulted in the desired product having a low degree of water proofness and in the prior art there are descriptions of processes directed to overcoming such deficiencies. Thus in U.S. Pat. No. 3,372,072 there is described a process wherein a water bearing explosive is gelled by copolymerizing in situ a mixture of mono- and polyethylenically unsaturated monomers soluble in the system to give products ranging from pourable yet cohesive water-resistant gels to rigid firm cohesive gels. From the prior art there may also be mentioned gelled explosive compositions similar in physical characteristics to those referred to above and described in U.S. Pat. No. 2,826,485 wherein gelation is achieved by means of hydrophilic non-peptizable linear polymers derived from ethylenic monomers and containing carboxyl or amide groups; in U.S. Pat. No. 3,072,509 wherein guar gum is used in conjunction with sodium tetraborate; in U.S. Pat. No. 3,202,556 wherein galactomannans are gelled by antimony or bismuth compounds in the presence of a base; and in U.S. Pat. No. 3,312,578 wherein a polysaccharide is reacted with a metal chromate and crosslinking is delayed by an agent derived from oxalic, citric, tartaric or gluconic acid. In U.S. Pat. No. 3,344,004 there is provided an elastic cohesive three dimensional, nonpourable gelled explosive composition comprising a gelling agent which was a water soluble anionic polymer which contains carboxylate groups and a crosslinking agent which was a hydroxy compound of aluminum, iron or chromium. In U.S. Pat. No. 3,344,004 it is taught that crosslinking agents such as borates are not suitable since they provide gels which are brittle and non-cohesive and such gells are stated to be unsatisfactory.

It is apparent from the teaching of the prior art that hitherto it was considered highly desirable to prepare only those water-based gelled products which were cohesive and which were either pourable or in a rigid firm form. This view is reinforced by the teaching of U.S. Pat. No. 3,344,004 wherein brittle and non-cohesive gels are stated to be unsatisfactory.

We have now found that water-based non-cohesive gels, hereinafter referred to as friable gels, which were formerly considered to be undesirable in the prior art, have an unexpected and surprisingly useful utility in explosives technology when used in the form of cartridges wherein the gel is packaged in a container comprising paper.

Accordingly we provide a process of cartridging a water bearing explosive composition which process comprises firstly, preparing a friable gelled explosive composition comprising at least one water soluble inorganic oxygen releasing salt, water and a synthetic polymeric gelling agent prepared in situ; and secondly packaging said composition in a container comprising paper.

We also provide a cartridge comprising a water bearing explosive composition characterized in that the said composition is a friable gelled explosive composition comprising at least one water soluble inorganic oxygen releasing salt, water and a synthetic polymeric gelling agent prepared in situ and in that the said composition is located in a container comprising paper.

In the drawings, FIGS. 1, 2, 3 and 4 are schematic views illustrating the formation of an unsealed cylindrical cartridge from a sheet of non-resilient pliable material.

In referring to the compositions as being friable we mean that the compositions are capable of being easily reduced to small fragments or being crumbled. It will be appreciated that dependent on the nature of the compositions there will be a range of degree of friability and the extent of fragmentation will be variable.

The nature of the synthetic polymeric gelling agent is not narrowly critical. However it should be capable of providing a means whereby the composition is converted to a friable form. Thus for example it may be a polymer of high molecular weight capable of absorbing or adsorbing the bulk of the other components of the composition. Alternatively and preferably it may be a polymeric material which has been crosslinked sufficiently to provide a friable composition and in general terms such crosslinking is usually of a higher degree than that required for the preparation of conventional cohesive gels. Suitably the polymeric agent may be prepared in situ in the composition from synthetic polymeric material by reacting the polymeric material with an appropriate redox system. From amongst polymeric materials suitable for use in the preparation of the synthetic polymeric gelling agent there may be mentioned polymeric compositions characterized in that the polymeric compound thereof is soluble at least in part in an aqueous medium and comprises at least one synthetic polymer which is soluble in an aqueous medium and which is derived from a monomer which carries at least one group which is capable of reacting with a metal ion or which may be converted to a form capable of reacting with a metal ion. Preferably the synthetic polymer is a copolymer or terpolymer and more preferably the polymer comprises a polymeric constituent derived from an unsaturated monomer. Such polymers and copolymers are described in copending commonly assigned application Ser. No. 445,782 filed Feb. 25, 1974 the subject matter of which is incorporated by reference; these are especially useful as the polymeric material from which our polymeric agent may be prepared and such polymers and copolymers are incorporated herein by reference. Typical polymeric materials described in application Ser. No. 445,782 include copolymers or terpolymers derived from unsaturated monomers such as acrylamide, vinyl pyrrolidone, vinyl alcohol, certain unsaturated acids such as methacrylic acid or derivatives thereof such as dimethylaminoethyl methacrylate and the like, and containing a group capable or reacting with metal ions. Suitably such a group is a chelating or chelate forming group, for example a polydentate group such as a bidentate group. Examples of such groups include a beta-ketoacyloxy group, o-hydroxybenzoyl group, salicylate groups alpha:beta dihydroxy substituted groups, alpha:-beta-dioxime group, thioacetic acid and esters and ethers thereof, alpha-aminosulphonic acid, 8-hydroxyquinoline, o-aminophenol, o-nitrophenol, o-aminothiophenol, ethylene diamine, alpha:beta-disecondary amines of the type $RNH—CH_2—CH_2—NHR$, alpha:-beta-ditertiary amines of the type $R_2N—CH_2—CH_2—NR_2$, alpha-beta-dithioethers of the type $R—S—CH_2—CH_2—S—R$, oxalyl group, alpha-hydroxy-oxime group, beta-diketo group including the mono and dioximes, and salicylindenimino groups.

So as to exemplify monomers containing such groups it may be mentioned that copolymers prepared from specific monomers such as methyacrylate hydrazide, acryloyliminodiacetic acid, 5-allyloxymethyl-8-quinolinol, N-formylamido acrylic acid; 4-cyclopentene 1,3-dione, diacetone acrylamide; 3-(2-hydroxy-3-naphthoyloxy) propyl acrylate; or (meth)acryloxymethyl-salicylate have been found to be useful. Copolymers derived from methacryloyl acetone or 2-acetoacetoxyethyl-methacrylate are particularly useful. It is often advantageous to use terpolymers formed from monomers referred to above and containing as a further component a polymeric constituent derived from a monomer such as for example alkyl acrylates, alkyl methacrylates, vinyl acetate, vinyl propionate, vinyl pyridine, vinylidene chloride, styrene, acrylonitrile, alkyl vinyl ethers, allyl acetate, dialkyl maleates or dialkyl fumarates.

As typical examples of polymeric materials useful in the preparation of our polymeric agent there may be mentioned polymers such as polyacrylamide; copolymers derived from combinations of monomers such as acrylamide and methacryloylacetone, or from acrylamide and 2-acetoacetoxyethylmethacrylate, or from N-vinylpyrrolidone and 2-acetoacetoxyethylmelthacrylate; or derived from combinations of monomers such as acrylamide, methacryloylacetone and acrylonitrile, or from acrylamide, 2-acetoacetoxyethylmethacrylate and acrylonitrile, or from acrylamide, methacryloylacetone and methyl methacrylate, or from acrylamide, 2-acetoacetoxyethylmethacrylate and vinyl acetate or from acrylamide, 2-acetoacetoxyethylmethacrylate and methyl methacrylate.

The polymeric agent used in the process referred to above may also be prepared from a synthetic polymeric material which has been combined with other materials capable of forming gels, for example naturally occurring gums such as the galactomannans of which guar gum or locust bean gum are typical examples, or the well known biosynthetic gums such as for example the xanthan gums prepared by the microbial transformation of carbohydrate material such as those gums prepared from glucose by treatment with micro-organisms of the genus *Xanthomonas*, for example the plant pathogen *Xanthomonas campestris*. Whilst such polymeric agents may be prepared from mixtures of the synthetic polymeric material and the gum it is preferred to react the components together. Thus for example a mixture of acrylamide and methacryloyl acetone or a mixture of acrylamide and 2-acetoacetoxyethylmethacrylate may be cografted on to the gum to provide a graft copolymer.

As mentioned hereinabove the polymeric agent used in our process may be prepared from synthetic polymeric material by reacting the polymeric material with an appropriate redox system. With the proviso that the redox system or a product derived therefrom shall contain a metal ion or a metal ion complex capable of reacting with the polymeric material the nature of the redox system, when used, is not otherwise narrowly critical. From amongst oxidizing materials suitable for use in such a redox system there may be mentioned for example chromium compounds such as sodium or potassium dichromate, sodium, potassium, barium, zinc or ammonium chromate, lead acetate; hydrogen peroxide, or the persulphates such as sodium persulphate. From amongst suitable reducing agents for the redox system there may be mentioned for example ferrous compounds such as ferrous chloride, gluconate or lactate; stannous compounds such as stannous chloride; selenous compounds such as selenium dioxide; arsenious compounds such as arsenious oxide; antimonious compounds such as potassium antimony tartrate; derivatives of carbamic acid such as urea or thiourea; sodium thiosulphate; or dicarboxylic acids such as fumaric, maleic, or malonic acid. By simple experimentation a suitable choice of components for the redox system may be made for a desired purpose. The degree of friability of the composition may also be controlled further for example by varying the ratio of the amount of polymeric material to the amount of the redox system; by varying the ratio of the components of the redox system; or by control of temperature or pH of the water bearing system for which the process is being used. Useful products may be obtained where the polymeric material constitutes up to about 10% w/w of the water bearing system. More usually the polymeric material constitutes from about 0.1 to 5% w/w, preferably from 0.15 to 2% w/w for example from 0.2 to 0.5% w/w of the water bearing system. The ratio of the amount of polymeric material to the amount of redox material in the water bearing system will depend to some extent on the nature of components and the degree of friability which is desired. Such a ratio may be determined by simple experimentations. We have found for example when using a typical polymeric material such a terpolymer derived from acrylamide, methacryloyl acetone and acrylonitrile in a molar ratio of about 95 : 2.5 : 2.5 that the weight ratio of the polymeric material to the redox material may suitably be in the range from 1 : 0.025 to 1 : 10, and preferably in the range from 1 : 1 to 1 : 5.

The container may be formed from the sheet by any folding procedure, for example, the sheet may be formed into a cylinder with overlapping sides and the ends held together by e.g. crimping. The folded containers so obtained are thereby in an unsealed form by which is meant that closure of the container is effected by suitable arrangement of the folded portions of the sheet, thereby eliminating the need to use mechanical sealing means such as staples, pins, tapes, string and the like or adhesive sealing materials to effect closure. One typical arrangement of the folded portions of a container is shown in the drawings wherein a laminate of paper and aluminium foil in the form of a sheet is converted to a container.

In FIG. 1 there is shown a shaped sheet from which a container is to be made.

Figure 1:
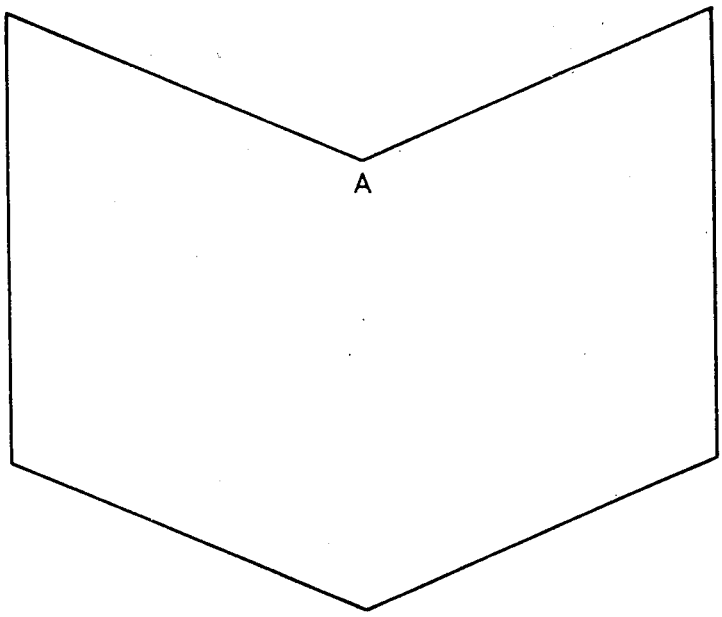
Figure 2:
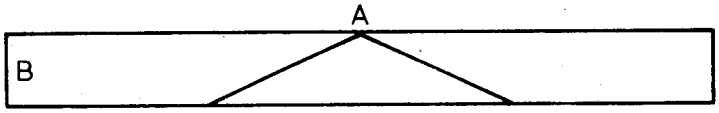
FIG. 2 shows an open ended cylinder formed by rolling the sheet in a manner such that point A of FIG. 1 is approximately equidistant from the open ends of the cylinder. The symbol B represents the mid point of the end of the cylinder so formed.
Figure 3:
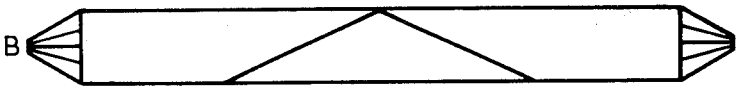
FIG. 3 shows a partially completed container wherein the open ends have been treated in a crimp forming head so as to fold the ends of the cylinder to provide six folds.
Figure 4:
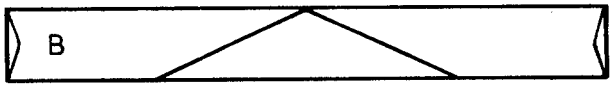
FIG. 4 shows the desired container after the folded ends have been pushed axially into the body of the cylinder to form a closed unsealed container suitable for use as a cartridge casing.
Figure 5:
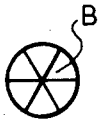

FIG. 5 is a view of an end of the container of FIG. 4. So as to simplify the drawings the explosive composition, which would be placed on the sheet of FIG. 1 when a cartridge is made, is not shown. Nitroglycerine cartridges are commonly formed by this method, and apparatus and procedures for cartridging nitroglycerine are well-known to those skilled in the art.

As typical examples of such apparatus there may be mentioned the well-known cartridging machines commonly referred to being of the Rollex type or of the duPont type.

In the Rollex type the Explosive is placed in contact with the sheet and the sheet is folded around the explosive to form the cartridge and finally the ends of the cartridge are crimped. In the duPont type a cartridge casing with an open end is preformed, an explosive composition is placed into the cartridge casing and the open end of the cartridge so formed is closed by crimping. Other forms of apparatus will be obvious to those skilled in the art for packaging nitroglycerine explosives.

The nature of the sheet of non-resilient pliable material is not narrowly critical. By non-resilient pliable material we mean material of the so-called dead-fold type, i.e. material which may be bent or creased into place and on the forming pressure being released the bends or creases remain. A typical example of such dead-fold material is aluminum foil.

The materials used to package nitroglycerine explosives may be used to form the cartridges of our invention.

Typical examples of such containers are those fabricated from coated paper or cardboard which has been waxed or lacquered, or to which has been applied a coating of a plastic material such as for example polyvinylidene chloride. The containers may be fabricated from paper based materials in the form of single sheets or in the form of laminates. Laminates based on paper and comprising metal foils, such as aluminum foil, are very useful. If desired the paper based materials may be treated with colouring materials such as dyestuffs or pigmentary materials. Cartridges of explosive compositions prepared by the process described hereinabove have been stored for prolonged periods, for example six months, without exudation of the composition from the container. This is in contradistinction to the prior art cohesive water based explosives which are very prone to exude from cartridges used conventionally for nitroglycerine based explosives and thus can only be cartridged if a more expensive plastic, for example polyethylene or polyethylene terephthalate, cartridge material is used. Even when such cartridging is effected it is difficult, if not impossible, to perform such an operation on a commercial scale by mechanical means using for example techniques and equipment used conventionally to pack cartridges explosives based on introgylcerine since the rheological properties of nonfriable water based explosive compositions are not conducive to such packaging techniques.

In the description hereinabove reference has been made to means whereby a synthetic polymeric gelling agent may be made. In the instances wherein the said agent is prepared by reacting the synthetic polymeric material of the aforesaid application Ser. No. 445,782 with a redox system, both the process of preparation and the products obtained thereby are novel. While that application describes new polymeric materials which may be converted to a gel form by reacting the polymeric materials in an aqueous media with a metal ion, we have now discovered a process whereby the rate of gelation of the said polymeric materials in a water bearing system may be controlled more easily if they are reacted with chemicals which form a redox system as hereinbefore described.

Accordingly we provide a process for the gelation of the synthetic polymeric materials described in the aforesaid application Ser. No. 445,782 which process comprises mixing water, said polymeric material and at least two compounds which together form a redox system and wherein said redox system or a product or products derived therefrom comprises at least one metal ion capable of reacting with said polymeric material.

The process of gelation described above has ben found to be very useful in preparing gelled water bearing systems particularly such systems containing an electrolyte. By suitable choice of the polymeric material and the components of the redox system we have prepared a range of gels derived from water bearing systems wherein the gels are formed over differing periods of time ranging from a few minutes to several hours after the addition of the components of the redox system to the water bearing system. Accordingly in an embodiment of our invention we provide a gel, as hereinbefore defined, of a water bearing system, preferably a system containing an electrolyte, characterized in that said gel comprises a reaction product derived from at least one synthetic polymeric material as described in the aforesaid application Ser. No. 445,782 and a redox system as hereinbefore described.

The gelation process described above is useful for making explosive compositions such as gelled aqueous blasting agents. Accordingly in a further embodiment of our invention we provide a gelled water bearing explosive composition comprising at least one water soluble inorganic oxygen releasing salt; water; at least one fuel; and a gelling agent comprising a reaction product derived from at least one synthetic polymeric material as described in the aforesaid application and a redox system as hereinbefore described.

Dependent upon the proportions of the components in the above explosive compositions and the nature of the gelling agent a variation in the degree of gelation may be achieved to provide products of differing consistencies ranging from pumpable to very friable to slightly cohesive.

The oxygen releasing salts suitable for use in the explosive compositions referred to hereinbefore are the conventional types used in compositions which are commonly referred to as slurry explosives. Thus they may be, for example, inorganic nitrates, chlorates and perchlorates and mixtures thereof. We prefer that the oxygen releasing salt material be chosen from the nitrates of the alkali and alkaline earth metals or ammonium and of these we prefer sodium nitrate, calcium nitrate and ammonium nitrate. The amount of oxygen releasing salt in explosive compositions made by our process is not narrowly critical; we have found that compositions containing amounts of oxygen releasing salts from 50% w/w to 90% w/w of the total composition are satisfactory and amounts from 65% w/w to 85% w/w are preferred. The particle size and shape of the oxygen releasing salt is not narrowly critical and is well known from the art of ammonium nitrate manufacture; powders and prilled particles are satisfactory.

When referring to fuels or fuel materials in these gelled compositions we mean substances which are stable in such explosive compositions, that is prior to detonation, during preparation and storage the substance is chemically inert to the system. The said substances must be combustible and their physical nature should be such that they may be incorporated in our compositions in a manner so as to be uniformly distributed throughout the compositions. Such fuels are well known in the art and they may be organic or inorganic and may also be derived from animals and plants.

The fuels employed in the compositions prepared by the process of this invention can be, for example, self-explosive fuels, non-explosive carbonaceous, non-metallic and metallic fuels or mixtures of the aforementioned types of fuels. They can be varied widely. Examples of self-explosive fuels include one or more organic nitrates, nitrocompounds and nitramines such as trinitrotoluene, cyclotri (or tetra) methylenetri (or tetra) nitramine, tetryl, pentaerythritol tetranitrate, explosive grade nitrocellulose and nitrostarch.

The self-explosive fuel can be for example in any of the well known flake, crystalline or pelleted forms. In general up to 35%, say from 10 to 30%, by weight based on the weight of composition of self-explosive fuel may be used.

Suitable water soluble fuels are organic water soluble substances for example carbohydrates such as sugars or molasses, water soluble alcohols or glycols, glues or mixtures of these. Suitably the proportion of water soluble fuel in such explosive compositions is in the range from 0.8% w/w to 20% w/w of the total composition. Amounts from 2% w/w to 7% w/w of the total composition are preferred.

Suitable water insoluble or sparingly water soluble fuels may be chosen from inorganic materials for example sulphur, aluminium, silicon, ferrosilicon, ferrophorphorus, magnesium, titanium, boron, mixtures thereof for example mixtures of aluminium with ferrosilicon, or organic materials for example powdered polymeric material such as polyvinylisobutyral, polyurethane, polystyrene, finely divided charcoal, anthracite, gilsonite, asphalt, fuel oil, cellulosic materials such as paper pulp, wood pulp, woodmeal or sawdust, or cereal products for example flours, dextrins starches. Waste products such as coffee grounds or breadcrumbs are also useful. When the inorganic fuel is a metal it is preferably in granulated or powdered form ranging in particle size from coarse, for example retained on a 30 mesh sieve, to very fine for example passing a 325 mesh sieve. Such granulated or powdered metal may be in the form of discrete regular shaped particles, but metal powders wherein the metal is in the form of irregular shaped particles, or in flakes or in the form of aggregates of particles or flakes are also satisfactory. Preferred fuels are the metallic powders. The most preferred metallic fuel is aluminium. The proportion of water insoluble or sparingly water soluble non-metallic fuels in such compositions may suitably be up to 10% w/w of the total composition and amounts from 1% w/w to 5% w/w of the total compositions are preferred. The proportion of metallic water insoluble fuels when present in such compositions may be as high as 25% w/w and amounts in the range from 0.5% w/w to 20% w/w of the total compositions are preferred.

The proportion of water in the explosive compositions made by our process should be sufficient to dissolve at least a part of the oxygen releasing salt, at least a part, preferably all, of the polymeric material prior to the reaction thereof with the redox system, and at least part of any water soluble fuel which may be present. Suitably the amount of water present may constitute from 5 to 35% w/w of the total composition but the amount present should not be in excess of the explosive limit of the composition. Usually amounts of water in the range from 15 to 25% w/w preferably from 15 to 17% w/w of the total composition provide explosive compositions which are useful for blasting activities where a pumpable pourable explosive material is desired.

During the course of experimentation with the gelation process of our invention we have observed that explosive compositions made by our process and comprising a gelling agent as hereinbefore described and an amount of water which constitutes from 5 to 14% w/w, preferably from 8 to 11% w/w, of the composition, exhibited some properties which were nonpredictable and highly unexpected. It would have been expected from our experience and from the prior art that such compositions would have been of a pourable or pumpable nature and that their general physical appearance would be of a non-friable or somewhat rubbery consistency. Surprisingly we observed that such compositions were friable and rather crumbly. In general appearance and physical form they were very similar to certain of the well known gelled explosives based on nitroglycerine. Accordingly we provide in a still further embodiment of our invention a gelled water bearing explosive composition comprising at least one water soluble inorganic oxygen releasing salt; at least one fuel, water in an amount which constitutes from 5 to 14% w/w, preferably from 8 to 11% w/w, of the said composition; and a gelling agent comprising a reaction product derived from at least one synthetic polymeric material as described in the aforesaid application Ser. No. 445,782 and at least two compounds which together form a redox system and wherein said redox system or a product or products derived therefrom comprises at least one metal ion capable of reacting with said polymeric material.

In common with the explosive compositions of our invention described hereinbefore the friable explosive compositions described in the immediately previous paragraph exhibited excellent resistance to leaching of the water soluble components by water. We also found that the friable explosive compositions described in the immediately previous paragraph were eminently suitable as an explosive composition which could be used as a component in our process described hereinbefore whereby water bearing explosive compositions are cartridged in containers comprising paper.

Where desirable it is convenient to add to the explosive compositions prepared by our process, in amounts expressed as parts by weight per 100 parts by weight of the final mixture, other additives conventionally used in slurry explosives. Such additives may include for example anti-foaming agents, for example ethyl hexanol, in amounts ranging e.g. from 0 to 0.1 part, surfactants, for example non-ionic surfactants such as alkylene oxide condensates of phenols or amides, from 0 to 5 parts. When desired, sensitizers in the form of gas or a mixture of gases such as air may be added to such compositions. Thus it may be added in the form of injected or stirred in air or gas or it may be added as air or gas encapsulated in or attached to the surface of particulate material. Alternatively a gas, such as nitrogen or carbon dioxide, may if desired be generated in the composition by known means. Yet again further sensitizers in the form of organic materials such as amines or glycols such as ethylene glycol mononitrate or in the form of modified metallic powders may be added to the explosive compositions. Such modified metallic powders include for example the reaction product of aluminium powder with resin acids, rosin or derivatives thereof. If desired there may also be added to the explosive compositions additional gelling agents already known in the prior art. Such explosive compositions may be prepared by conventional means. Thus for example it is convenient to prepare a premix of the oxygen releasing salts and water insoluble fuels if such fuels are used. To this premix there may then be added an aqueous solution comprising the bulk of the water in which any water soluble fuels, if used, and the polymeric material had been predissolved so as to form a mixture. An aqueous solution of the redox compounds in the remainder of the water may then be added to and admixed with the mixture described above, so as to form a gelled product.

A further example of a procedure whereby our explosive compositions may be prepared is one which comprises the steps of preparing an aqueous solution containing a suitable polymeric material and a reducing component of a suitable redox system, a portion of the oxygen releasing salt and water soluble fuel material if such fuel material is used. To this solution there may then be added the remainder of the oxygen releasing salt, water insoluble fuel material if used and the oxidizing component of the redox system. The mixture so prepared is then stirred to provide a uniform composition. In a variant of the above procedure it is sometimes advantageous to add only a portion of any water insoluble fuel, for example a portion of a metallic fuel, to the mixture prior to the introduction of the oxidizing component and after a preliminary initial mixing to then add the remainder of the water insoluble fuel prior to subjecting the resultant composition to a final mixing treatment.

The proportion of the gelling agent in such explosives compositions may conveniently be in the range from 0.1 to 5% w/w, more usually from 0.2 to 3% w/w, of the composition. Such compositions comprising our gelling agents are easier to prepare than similar compositions of the prior art since the gelling agents are formed in situ from water soluble components to form a matrix. Unlike prior art compositions using, for example guar gum, no prehydration of the gelling agents is necessary. Additionally the explosive compositions as described above are markedly superior to prior art compositions in resistance to degradation during storage and in resistance to leaching of the components when the compositions are in contact with aqueous media, for example when in contact with water in a borehole when used in processes of blasting and have thus enabled improvements to be made in blasting processes. By means of the use of explosive compositions described above it is now possible to perform blasting operations in areas where hitherto, because of the presence of water in such areas, it has been difficult to detonate water bearing explosive compositions. Furthermore the process described herein whereby water based explosives may be cartridged in paper based containers and the cartridges obtained by such a process provide an important advance in the technology of explosives in so far as they provide a safe alternative to the more hazardous known nitroglycerine explosives.

Our invention is now illustrated, but in no way limited to, the following examples in which all parts and percentages are on a weight basis unless otherwise stated.

EXAMPLES 1 to 14 inclusive

These examples demonstrate a process whereby an explosive composition may be converted to a gelled form at varying rates by means of our process.

In a mixing device conventionally used for preparing explosive compositions there was prepared a first mixture consisting of

| | |
|---|---|
| Ammonium nitrate prills | 350 parts |
| Sodium nitrate | 100 parts |
| Sugar | 40 parts |
| Water | 100 parts |
| Ethylene glycol | 5 parts |

and an amount as indicated in Table 1 of a terpolymer derived from acrylamide, methacryloyl acetone and acrylonitrile in a molar ratio 95 : 2.5 : 2.5, together with the component or components of the redox system, other than sodium dichromate, as set out in Table 1. Into this first mixture there was incorporated a second mixture consisting of

| | |
|---|---|
| Pregelled starch | 15 parts |
| Atomized aluminium* | 80 parts |

-continued

| | |
|---|---|
| Paint fine aluminium** | 20 parts |
| Ammonium nitrate powder | 260 parts |

*The atomized aluminium was in the form of a powder the bulk of which was capable of passing through a 200 mesh sieve. It was available commercially under the designation of "Aluminium Powder 125" from Alcoa of Australia Limited.
**The paint fine aluminium was in the form of a powder the bulk of which was capable of passing through a 325 mesh sieve and was available from Alcoa of Australia Limited under the designation "Aluminium Powder No. 408".

To the resultant blend there was then added in 20 parts of water the amounts of sodium dichromate set out in Table 1 under the heading "Redox System." The composition so obtained was blended for one minute and allowed to stand at 25° C. The time taken for the composition to be converted to a gel form is set out in Table 1.

TABLE 1

| Example No. | Terpolymer parts | Redox System: Sodium Dichromate parts | Thiourea parts | Other ingredient parts | Time to gel |
|---|---|---|---|---|---|
| 1 | 10 | 1 | — | 1 Potassium Antimony tartrate | 2 minutes |
| 2 | 5 (1) | 2 | 2.5 | — | 15 minutes |
| 3 | 7 | 2 | 2.5 | 1 Selenium dioxide | 18 minutes |
| 4 | 7 | 2 | — | 10 Arsenious oxide | Less than 30 minutes |
| 5 | 10 | 0.5 | — | 0.5 Selenium dioxide | 60 minutes |
| 6 | 7 | 2 | 2.5 | 1 Selenium dioxide | 45 minutes |
| 7 | 10 | 2 | 2.5 | — | Between 1 and 2 hours |
| 8 | 7 (2) | 2 | 2.5 | — | Between 2 and 3 hours |
| 9 | 7 | 2 | — | 1 Selenium dioxide | Between 2 and 3 hours |
| 10 | 5 | 2 | 2.5 | — | Between 4 and 6 hours |
| 11 | 10 | 0.5 | 2.5 | — | About 5 hours |
| 12 | 10 | 2 | 1 | — | About 6 hours |
| 13 | 7 (3) | 2 | 2.5 | — | About 6 hours |
| 14 | 10 | 0.5 | — | 0.5 arsenious oxide | About 5 hours |

Notes relating to Table 1
(1)In Example 2 an additional 2 parts of guar gum was dispersed in the composition.
(2)In Example 8 the thiourea was omitted from the first mixture and was added to the composition at the same time as the sodium dichromate.
(3)In Example 13 the pH of the blend was adjusted to 4.5 prior to adding the sodium dichromate.

The products so obtained were in the form of crumbly, friable gels which showed excellent resistance to leaching of the water soluble components when immersed in water. The resistance to leaching by water of the soluble components from the composition was tested by the following procedure. An amount of the composition which had gelled for 24 hours and containing 10 grams of ammonium nitrate was placed in a mesh basket ans suspended in 200 ml of water at room temperature. After 17. minutes the basket and its residual content was removed from the aqueous medium. The aqueous medium was then stirred until it was homogeneous and a 50 ml aliquot taken therefrom was analysed for its ammonium nitrate content. The above procedure was repeated after the gelation had proceeded for two months. The precentage of the ammonium nitrate retained in treated typical composition, based on the original ammonium nitrate content thereof, is set out in Table 2.

TABLe 2

| Composition of Example No | % Ammonium Nitrate Retained: After 24 hours gelation | After 2 months gelation |
|---|---|---|
| 3 | 58 | 61 |
| 4 | 53 | 57 |
| 7 | 58 | 56 |
| 9 | 57 | 50 |

EXAMPLE 15

To 50 parts of a 60% solution of ammonium nitrate in water there was added 100 parts of an aqueous 11% solution of the terpolymer used in Examples 1 to 14 and 2 parts of thiourea. The resultant mixture was stirred to a homogeneous solution and there was then added thereto with stirring 6 parts of sodium dichromate dissolved in 12 parts of water. A gel was formed after the composition so obtained had stood at 25° C for 2 hours.

EXAMPLE 16

50 parts of an aqueous 11% solution of the terpolymer used in Examples 1 to 14 was diluted with 20 parts of water and to this diluted solution there was added 2 parts of selenium dioxide. The resultant mixture was stirred to give a homogeneous solution and there was then added thereto with stirring 1 part of potassium dichromate. The composition so obtained was allowed to stand at 25° C and it was observed that a gel commenced to form after about 1 hour and 2 hours after the addition of the potassium dichromate the composition was in the form of a rigid gel.

EXAMPLE 17

In a mixing device conventionally used for preparing explosive compositions a blend was prepared by mixing 320 parts of ammonium nitrate prills, 110 parts of sodium nitrate and 5 parts of thiourea. To the agitated blend there was then added firstly 67 parts of an aqueous solution which contained 5 parts of a copolymer derived from acrylamide and 2-acetoacetoxy ethylmethacrylate in a molar ratio of 97:3 and secondly 48 parts of water and the resultant mixture was then heated to a temperature of 55° C. To the stirred mixture there was then added 304 parts of powdered ammonium nitrate, 75 parts of "Aluminium powder 125," 20 parts of woodmeal, 30 parts of sugar and 4 parts of potassium dichromate. This resultant material was stored for 30 minutes and then stirred for 10 minutes after which time 25 parts of "Aluminium Powder No. 408" was incorporated into the material by mixing to provide a crumbly friable gelled explosive composition. An amount of the explosive composition so obtained was fed to a cartridging machine of the so called "Rollex" type which is well known and conventionally used in the manufacture of cartridges of nitroglycerine explosives. By means of this machine the composition was loaded into cylindrical cartridges which were 8 inches long and had a diameter of 1⅛ inches. The cartridges were formed from single sided waxed paper used conventionally in the manufacture of nitroglycerine explosives. It was found that the cartridges could be initiated at a temperature of 10° C by means of one No.6 copper detonator. The velocity of detonation was 2700 meters per second.

EXAMPLE 18

The general procedure of Example 17 was repeated except that in the present example the Rollex type of cartridging machine was replaced by a cartridging machine of the so called "du Pont" type which is well known and conventionally used in the manufacture of cartridges of nitroglycerine explosives. By means of this machine there was obtained a cartridged explosive composition in the form of cylindrical cartridges which were 8 inches long and had a diameter of 1⅛ inches and wherein the cartridges were formed from double sided waxed paper used conventionally in the manufacture of nitroglycerine explosives. The cartridges so obtained were initiated at a temperature of 20° C by means of one No.8 aluminium detonator. No exudation of the explosive composition through the paper was observed after the cartridges had been stored for four weeks.

EXAMPLE 19

The general procedure of Example 17 was repeated except that the copolymer of that example was replaced by 5 parts of a terpolymer derived from acrylamide, 2-acetoacetoxy ethylmethacrylate and acrylonitrile in a molar ratio of 94:3:3. The waxed paper of Example 17 was replaced in the present example by a waxed polyvinylidene chloride coated paper. There was thus obtained detonable explosive cartridges which showed no exudation of the explosive composition after storage at room temperature for 6 months.

EXAMPLE 20

During the construction of a drainage tunnel which was approximately 5 feet high and had a floor width of 3 feet and which was situated 50 feet underground in a limestone quarry, four holes each 3 feet deep and 1½ inches in diameter were bored in the limestone face. Into the bottom of each of the holes there was placed a 4 inch length of a cartridge which has been prepared as described in Example 17. The explosive composition was detonated successfully in a blasting operation by means of one No.8 aluminium detonator which was attached to each cartridged composition and connected to a length of safety fuse.

EXAMPLE 21

The face of a limestone quarry was dressed by firstly drilling into a protruding section of limestone four holes each 6 feet deep and of 2 inches diameter the holes being spaced at intervals of 6 feet; secondly, inserting into each hole a cartridge prepared as described in Example 17; and thirdly, firing the cartridges by means of detonating cord connected to the cartridges.

EXAMPLE 22

During a trenching operation boreholes which were 14 inches deep and had a diameter of 1½ inches were drilled into a rockface. In each of the boreholes there was placed a 4 inch length of a cartridge prepared as described in Example 17. Each of the cartridges was detonated by means of one No.8 aluminium detonator.

EXAMPLE 23

6 parts of thiourea was dissolved in 43 parts of water and added to 60 parts of an aqueous 5% solution of a copolymer derived from acrylamide and 2-acetoacetoxyethylmethacrylate in a molar percentage ratio of 99.5 : 0.5. To the solution so formed there was added 320 parts of ammonium nitrate, 110 parts of sodium nitrate and 25 parts of sugar and the resultant mixture was heated at 60° C until solution of the components was effected. There was then admixed into the solution so obtained 310 parts of ammonium nitrate, 75 parts of "Aluminium Powder 125," and 25 parts of woodmeal. When the mixture was homogeneous 2.5 parts of sodium dichromate was added and mixing was continued for 5 minutes, after which time 25 parts of "Aluminium powder No. 408" was added and mixing continued for a further 1 minute. The resultant friable composition was cartridged by means of a Rollex cartridging machine into containers fabricated from a sulphite paper weighting 63 grams per square meter and which had been coated on one side with polyvinylidenechloride and on the other side with wax. The cartridges so obtained were stored for three months and after this time were used successfully in blasting operations. No exudation of the composition through the walls of the containers was observed during storage.

EXAMPLE 24

The general procedure of Example 23 was repeated but in the present example the copolymer solution of Example 23 was replaced by 80 parts of an aqueous 5% solution of a copolymer derived from acrylamide and 2-acetoacetoxyethylmethacrylate in a molar percentage of 96 : 4, the total water present was increased to 110 parts, the amount of thiourea was reduced to 5 parts, the sodium dichromate was replaced by 6 parts of potassium dichromate, and the paper used in the cartridges was a greaseproof paper. No exudation from the friable composition so obtained was observed during storage of the so prepared cartridges over a period of two months.

EXAMPLE 25

The general procedure of Example 23 was repeated except that in the present example there was added, subsequent to the addition of the sodium dichromate and prior to the addition of the "Aluminium Powder 408," 1.5 part of sodium nitrite. The copolymer solution of Example 23 was replaced by 40 parts of an aqueous 5% solution of a copolymer derived from acrylamide and 2-acetoacetoxyethylmethacrylate in a molar percentage ratio of 97 : 3. The amount of thiourea was increased to 7 parts and the total amount of water present was 105 parts. The paper used to prepare the cartridges was a sulphite paper weighing 63 grams per square meter and which had been waxed on both sides. Cartridges so formed and of a diameter of 35 millimetres were used to blast basalt rock during a tunnelling operation.

EXAMPLE 26

A mixture containing 360 parts of ammonium nitrate, 90 parts of sodium nitrate, 30 parts of sugar, 8 parts of a terpolymer derived from acrylamide, 2-acetoacetoxyethylmethacrylate and acrylonitrile in a molar percentage ratio of 89 : 4 : 7, 1.5 parts of thiourea and 100 parts of water was heated with mixing to 70° C. The resultant composition was then cooled to 40° C and the following materials were then mixed into the composition in the order set out below; 293 parts of ammonium nitrate, 35 parts of woodmeal, 65 parts of "Aluminium powder 125", 1 part of sodium dichromate and 20 parts of "Aluminium powder 408". The resultant friable composition was cartridged into containers fabricated from paper coated on one side with polyvinylidene chloride.

EXAMPLE 27

The general procedure of Example 26 was repeated but in the present example the woodmeal of Example 26 was replaced by a mixture of 15 parts of woodmeal and 20 parts of finely divided charcoal.

EXAMPLE 28

The general procedure of Example 24 was repeated but the thiourea of the Example was replaced by 5 parts of selenium dioxide.

EXAMPLE 29

Explosive cartridges were prepared by the general procedure of Example 25 but the woodmeal of the Example was replaced by 25 parts of rigid polyurethane foam which had been crushed to a powdered form.

EXAMPLE 30

Explosive cartridges were prepared by the general procedure of Example 25 except that in the present example the cartridge cases were fabricated from a laminated material comprising tissue paper weighing 26 grams per square metre to one side of which a nitrocellulose lacquer had been applied at the rate of 5 grams per square metre and wherein the other side was laminated to an aluminium foil which was 0.009 millimeter thick.

EXAMPLE 31

The general procedure of Example 23 was repeated except that in the present example 6.5 parts of thiourea was dissolved in 100 parts of water, the amount of "Aluminium powder 125" was increased to 90 parts, the amount of "Aluminium powder 408" was reduced to 10 parts, and the copolymer solution was replaced by 3 parts of a commercial grade of polyacrylamide.

EXAMPLE 32

The general procedure of Example 23 was repeated except that the copolymer solution of that Example was replaced in the present Example by 60 parts of an aqueous 5% solution of a copolymer derived from N-vinyl pyrrolidone and 2-acetoacetoxyethylmethacrylate in a molar percentage ratio of 99.6 : 0.4.

EXAMPLE 33

The general procedure of Example 23 was repeated except that the thiourea of the Example was replaced by 6 parts of urea.

EXAMPLE 34

A gelled explosive composition was prepared from a premix of ammonium nitrate (648 parts), sodium nitrate (30 parts), aluminium powder (100 parts), sugar (50 parts), water (65 parts) and thiourea (5 parts) to which there was then added to and uniformly admixed with the resultant mixture firstly 100 parts of an aqueous 10% solution of a terpolymer derived from acrylamide, methacryloylacetone and methyl methacrylate in a molar ratio of 87 : 3 : 10 followed by 2.5 parts of potassium dichromate.

EXAMPLE 35

The general procedure of Example 23 was repeated but the thiourea of the Example was replaced by 5 parts of maleic acid.

EXAMPLE 36

The general procedure of Example 23 was repeated but the woodmeal of that Example was replaced by 25 parts of woodpulp.

EXAMPLE 37

A premix was prepared by mixing 645 parts of ammonium nitrate, 30 parts of sodium nitrate, 100 parts of aluminium powder and 0.4 parts of thiourea. To this premix there was added 220 parts of an aqueous solution containing 50 parts of sugar and 1.5 parts of a terpolymer derived from acrylamide, methacryloylacetone and acrylonitrile in a molar ratio of 100 : 2.5 : 2.5 and the mixture was stirred until it was a uniform mass. A solution of 0.3 part of sodium dichromate in 3 parts of water was then added to the stirred mass; stirring was continued for 5 minutes. The resultant mixture was allowed to stand overnight at room temperature to provide a gelled pumpable water resistant explosive composition.

EXAMPLE 38

Preparation of a copolymer of acrylamide and acrylic acid (99.5 : 0.5 mole %) in 4% aqueous solution.

Acrylamide (18.9 parts) and acrylic acid (0.0096 parts) were dissolved in 458 parts of water to which were added 10% ammonium sulphate solution (3.8 parts) and isopropanol (1.0 parts). The solution was purged by a rapid stream of nitrogen for 20 min. after which 30% ammonia solution (0.5 parts) and 1% ammonium persulphate solution (2.7 parts) were added. Mechanical stirring was discontinued after 1 hr. and polymerisation allowed to continue under a slow stream of nitrogen for 24 hrs.

A 2% solution of this polymer had a "Brookfield" viscosity of 630 cp (at 5 rpm).

An explosive slurry was prepared as in Example 17 containing 0.25% of this polymer in place of the copolymer of Example 17. The slurry was gelled as in Example 17 using the $K_2Cr_2O_7$/thiourea system. The consistency of the resulting composition was satisfactory for cartridging on the Rollex machine and cartridges were free of exudation on examination after twelve weeks storage at ambient temperature.

The experiment was repeated exactly using the same molar proportion of methacrylic acid in place of acrylic acid. The resulting composition gave similarly satisfactory cartridges. Satisfactory results were also obtained using the crosslinking systems such as $CrCl_3.6H_2O$.

EXAMPLE 39

The explosive composition prepared in Example 17 was packed by the method of Examples 17 and 18 except that the following 'papers' were used in place of the single sided waxed paper.

1. Oriented polypropylene/aluminium foil laminate
2. High density polyethylene ($5^{thou}$)
3. Sarin ($5^{thou}$)
4. Rigid PVC foil ($5^{thou}$)

In each case a satisfactory cartridge was obtained which could be detonated successfully.

What is claimed is:

1. An explosive cartridge comprising a container formed from a sheet of non-resilient pliable material and within the container a water-bearing friable gelled explosive composition which comprises at least 50% w/w water-soluble inorganic oxygen releasing salt, at least one fuel and from 5 to 14% by weight of water gelled with from 0.1 to 5% by weight of the said composition of at least one complex which has been prepared by a process comprising the steps of (1) reacting under polymerising conditions a first water soluble monomer with at least one further monomer which carries a group which reacts with a metal ion or which may be converted to a form capable of reaction with a metal ion for a time sufficient to form a copolymer which is soluble at least in part in an aqueous medium and (2) forming a complex by reacting the copolymer so obtained with a redox system or a product or products derived from the redox system which comprises at least one metal ion.

2. A cartridge according to claim 1 wherein said first water soluble monomer is an unsaturated monomer.

3. A cartridge according to claim 2 wherein the said first water soluble monomer is selected from the group consisting of acrylamide, vinyl pyrrolidone, vinyl alcohol, methacrylic acid and dimethylaminoethyl methacrylate.

4. A cartridge according to claim 1 wherein the said metal ion is selected from the group consisting of chromium, zinc, lead, tin, selenium and iron ions.

5. A cartridge according to claim 1 wherein the redox system consists of an oxidising material selected from the group consisting of dichromates of sodium and potassium, chromates of potassium, barium, zinc and ammonia, lead acetate, hydrogen peroxide and sodium persulphate and a reducing agent selected from the group consisting of ferrous lactate, stannous chloride, selenium dioxide, arsenious oxide, potassium antimony tartrate, urea, thiourea, sodium thiosulphate, fumaric acid, maleic acid and malonic acid.

6. A cartridge according to claim 1 wherein the said group which reacts with a metal ion is a chelating or chelate forming group.

7. A cartridge according to claim 6 wherein the said group is a polydentate group.

8. A cartridge according to claim 6 wherein the said group is a bidentate group which contains two donor groups capable of forming a chelate ring with a metal.

9. A cartridge according to claim 1 wherein the said further monomer is selected from the group consisting of methacryloyl acetone, 2-acetoacetoxyethylmethacrylate, methacrylic hydrazide, acryloyliminodiacetic acid, 5-allyloxymethyl-8-quinolinol, N-formylamide acrylic acid, 4-cyclopentene 1,3-dione, diacetone acrylamide, 3-(2-hydroxy-3-naphthoyloxy)propyl acrylate, and (meth) -acryloxymethyl-salicylate.

10. A cartridge according to claim 1 wherein the said copolymer is a terpolymer comprising a constituent selected from the group consisting of alkyl acrylates, alkyl methacrylates, vinyl acetate, vinyl propionate, vinyl pyridine, vinylidene chloride, styrene, acrylonitrile, alkyl vinyl etheres, allyl acetate, dialkyl maleates and dialkyl fumarates.

11. A cartridge according to claim 10 wherein the said terpolymer comprises methyl methacrylate, vinyl acetate or a combination thereof.

12. A cartridge according to claim 10 wherein the said terpolymer comprises a constituent selected from the group consisting of naturally occurring gums and biosynthetic gums capable of thickening a water bearing system.

13. A cartridge according to claim 12 wherein the said terpolymer comprises a constituent selected from the group consisting of galactomannan gum and xanthan gum.

14. A cartridge according to claim 13 wherein the said terpolymer comprises guar gum.

15. A cartridge according to claim 1 wherein the weight ratio of said copolymer to the material of the said redox system is in the range from 1:0.025 to 1:10.

16. A cartridge according to claim 1 wherein the weight ratio of the said copolymer to the material of the said redox system is in the range from 1:1 to 1:5.

17. A cartridge according to claim 1 wherein the said explosive composition comprises firstly at least one oxygen releasing salt selected from the group consisting of ammonium nitrate, chlorate and perchlorate, alkali metal nitrates, chlorates and perchlorates and alkaline earth nitrates, chlorates and perchlorates present in an amount from 50 to 90% w/w; secondly water present in an amount from 5 to 14% w/w; thirdly, at least one fuel selected from the group consisting of water soluble fuel present in an amount from 0.8 to 20% w/w, non-metallic sparingly water soluble fuel and non-metallic water insoluble fuel present in an amount from 1 to 10% w/w parts, and metallic water insoluble fuel present in an amount from 0.5 to 25% w/w; and fourthly from 0.2 to 3% w/w parts of said complex.

18. A cartridge according to claim 17 wherein the said oxygen releasing salt is selected from the group consisting of ammonium nitrate, sodium nitrate and calcium nitrate and constitutes from 65 to 85% w/w of the said composition and wherein said complex constitutes from 0.2 to 0.5% w/w of the said composition.

19. A cartridge according to claim 17 wherein water constitutes from 8% to 11% w/w by weight of the said explosive composition.

20. A cartridge according to claim 1 wherein the explosive composition is packaged in a container fabricated from a material selected from the group consisting of paper based material and metal foil.

21. A cartridge according to claim 20 wherein the composition is packaged in a container fabricated from a material selected from the group consisting of aluminum foil, waxed paper, lacquered paper, paper coated with synthetic polymer material, and laminates of paper with metal foil.

22. A cartridge according to claim 21 wherein the composition is packaged in a container fabricated from paper coated with polyvinylidene chloride.

* * * * *

UNITED STATES PATENT OFFICE

CERTIFICATE OF CORRECTION

Patent No. 4,033,264 Dated July 5, 1977

Inventor(s) Frederick Bolza, Lubos Vojtech Sadek & Richard Fox

It is certified that error appears in the above-identified patent and that said Letters Patent are hereby corrected as shown below:

Please insert the following in the heading:

-- [30] Foreign Application Priority Data

October 5, 1973 Australia PB 5107 and
December 19, 1973 Australia PB 6059 --

Column 11, line 59 "17" should read --75--.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*